United States Patent [19]

Flückiger

[11] 4,106,547

[45] Aug. 15, 1978

[54] METHOD AND ARRANGEMENT FOR REMOVING A COOLED STRAND FROM A CONTINUOUS CASTING INSTALLATION

[75] Inventor: Friedrich Flückiger, Einsiedeln, Switzerland

[73] Assignee: Concast AG, Zurich, Switzerland

[21] Appl. No.: 790,179

[22] Filed: Apr. 25, 1977

[30] Foreign Application Priority Data

Apr. 27, 1977 [CH] Switzerland ..... 5247/77

[51] Int. Cl.[2] ..... B22D 11/00

[52] U.S. Cl. ..... 164/82; 164/428; 164/442; 72/251; 425/335

[58] Field of Search ..... 425/327, 394, 335, 384; 164/82, 428, 442; 72/251

[56] References Cited

U.S. PATENT DOCUMENTS

| | | | |
|---|---|---|---|
| 3,542,117 | 11/1970 | Lemper et al. | 164/442 X |
| 3,543,830 | 12/1970 | Baumann | 164/82 |
| 3,722,576 | 3/1973 | Gallucci | 164/82 |
| 4,010,792 | 3/1977 | Ishiguro et al. | 164/82 X |
| 4,030,531 | 6/1977 | Wunnenberg et al. | 164/82 X |

*Primary Examiner*—Robert L. Spicer, Jr.
*Attorney, Agent, or Firm*—Werner W. Kleeman

[57] ABSTRACT

A continuous casting installation has a curved roller apron and a withdrawal and straightening unit. The latter has upper and lower rollers, and the upper rollers are vertically movable so that a gap may be formed between the same and a strand which extends into the withdrawal and straightening unit. A heating device is provided for the strand and may be moved from a position laterally of the withdrawal and straightening unit into the gap between the upper rollers and the strand when the upper rollers are raised. The heating device is preferably arranged in the region of the tangent point. When a strand cools to such an extent that the withdrawal and straightening unit can no longer bend it, as may occur in the event of a breakout, the upper rollers beyond the tangent point are raised. The strand is then driven forward until, by virtue of its curvature, it touches the raised upper rollers. Due to the curvature of the strand, the latter touches the raised upper rollers at a location spaced from the tangent point and a gap exists between the raised upper rollers and the strand over the span from this location to the tangent point. The heating device is inserted in the gap and the strand is heated at a selected location to a temperature such that its resistance to bending is lowered sufficiently for it to be bent by the withdrawal and straightening unit. The upper rollers are lowered and the strand is bent at the selected location. The preceding operations are repeated until the strand can be removed from the installation.

18 Claims, 5 Drawing Figures

METHOD AND ARRANGEMENT FOR REMOVING A COOLED STRAND FROM A CONTINUOUS CASTING INSTALLATION

FIELD OF THE INVENTION

The present invention relates generally to the art of continuous casting. More particularly, the invention relates to a method and arrangement for removing a strand, especially a steel strand, from a continuous casting installation having a curved support section, as well as a withdrawal and straightening unit, when the bending resistance of the strand is so high that it can no longer be straightened by the withdrawal and straightening unit.

BACKGROUND OF THE INVENTION

Continuous casters of the curved type are in common use today and, for larger strands such as blooms and slabs, generally include a curved roller apron which is followed by a withdrawal and straightening unit. The roller apron supports the strand issuing from the continuous casting mold. One of the functions of the withdrawal and straightening unit is to bend and thereby straighten the strand as it advances out of the curved roller apron.

In the event of metal breakout occurring at a cast strand, the further casting of the strand is discontinued. The trailing end of the strand is normally severed from the remainder of the strand and lifted out of or otherwise removed from the caster together with the first section of the roller apron. Severing of the trailing end of the strand from the remainder thereof is generally necessary since the solidified molten metal in the region of the trailing end of the strand binds the strand to the roller apron and makes it impossible to move the strand in the caster. By severing the trailing end of the strand, the remainder of the strand then becomes free to move.

It is necessary that the strand be allowed to cool down somewhat before the trailing end is severed since the heat which would otherwise emanate from the strand would make it difficult for personnel to work adjacent to the strand. In addition, the section of the strand remaining in the caster, after removal of the trailing end, undergoes further cooling during the severing operation. Since the resistance to bending of the strand increases with decreasing temperature, it may happen that the cooled section of the strand remaining in the caster after the severing operation can no longer be bent by the withdrawal and straightening unit. This means that the cooled section of the strand remaining in the caster cannot be removed from the latter in the conventional manner employed during a casting operation. Thus, it is currently the practice to cut the cooled section of the strand into relatively short lengths and to remove the cooled section of the strand from the caster piece by piece.

One manner which is used for carrying out this procedure involves lowering one of the lower rollers of the withdrawal and straightening unit and thereafter bringing a protective element, such as a sheet, into position over the lowered roller from laterally of the caster. Subsequently, burners for cutting the strand are inserted between the protective element and the cooled strand. By alternately cutting the strand and then advancing the strand in the casting direction, the strand is cut into relatively short lengths which are removed from the caster one by one.

The procedure outlined above has several disadvantages. To begin with, there exists the possibility of damage to the expensive drive rollers and their bearings by the burners and/or by molten steel generated by the cutting operation. Furthermore, there is no guarantee that slag generated by the cutting operation will not remain in the withdrawal and straightening unit. In addition, due to the fact that the movable lower roller of the withdrawal and straightening unit must be lowered through a substantial distance, the withdrawal and straightening unit, as well as the foundation therefor, become expensive. Finally, since it is necessary to make several cuts with the burners, the downtime of the caster is large.

OBJECTS OF THE INVENTION

It is a primary object of the present invention to provide a method and arrangement which enable a cooled strand to be removed from a continuous caster in a simpler manner than heretofore.

Another object of the invention is to provide a method and arrangement which enable a cooled strand to be removed from a continuous caster in a shorter period of time than heretofore.

An additional object of the invention is to provide a method and arrangement which enable a cooled strand to be removed from a continuous caster with lower equipment costs than heretofore.

SUMMARY OF THE INVENTION

One aspect of the invention relates to a method of removing an arcuate cast strand from a continuous casting installation, which latter includes a withdrawal and straightening zone having a pressure exerting upper surface, e.g. defined by a plurality of rollers, for bending the strand, when the strand is so cold as to resist bending thereof by the upper surface of the withdrawal and straightening zone. The method involves raising the upper surface of the withdrawal and straightening zone so as to permit advancement of the strand in the casting direction, and advancing the strand in this direction. The strand is heated to a temperature sufficient to enable the strand to be bent by the upper surface of the withdrawal and straightening zone and the heating is carried out at a selected location such as to permit at least partial straightening of the strand via this upper surface. The strand is bent at the selected location thereof while the latter is at a temperature at which the strand is bendable, and the bending is accomplished by lowering the upper surface of the withdrawal and straightening zone and thereby exerting pressure on the strand.

Another aspect of the invention resides in a continuous casting installation useful for the performance of the method aspects of the invention. The installation comprises a curved support section for a continuously cast strand as well as a withdrawal and straightening unit downstream of the support section in the casting direction. The withdrawal and straightening unit has an upper portion which may, for example, include a plurality of rollers, and which is movable from a lowered position in which it normally contacts the strand to a raised position in which it is normally out of contact with the strand. A heating device is provided and is movable from a first position laterally of the withdrawal and straightening unit to a second position between the strand and the upper portion of this unit when the upper portion is in its raised position. The heating device permits heating of the strand in the second position to thereby lower the bending resistance of the strand when the latter resists bending by the withdrawal and straightening unit.

According to one embodiment of the invention, the strand is heated at its upper side only. According to another embodiment, the strand is also heated at its lower side. By heating the strand at both its upper and lower sides, rather than only at its upper side, the time required for heating the strand to a temperature at which it may be bent may be substantially shortened. In order to permit heating of the strand at its lower surface, a lower portion, e.g., a roller, of the withdrawal and straightening unit may be mounted for vertical displacement so that it can be lowered to permit insertion of a heating device between the same and the lower surface of the strand. It is noteworthy that the distance by which the movable lower portion must be lowered in order to permit heating of the lower surface of the strand may be substantially smaller than the displacement required in the prior method outlined above where the strand is cut into sections.

The strand is preferably heated in the region of the tangent point, that is, the point at which the strand goes from a curved configuration to a substantially linear configuration. Heating may be carried out upstream and/or downstream of the tangent point.

Advantageously, the strand is heated to such an extent that the surface temperature thereof lies between about 600° and 900° C. Even in the case of larger strands, such as slabs, it may then be expected that the strand will be sufficiently heated throughout to permit bending thereof in accordance with the invention.

BRIEF DESCRIPTION OF THE DRAWINGS

The invention will be better understood and objects other than those set forth above, will become apparent when consideration is given to the following detailed description thereof. Such description makes reference to the annexed drawings wherein.

DESCRIPTION OF THE PREFERRED EMBODIMENTS

Figure 1:
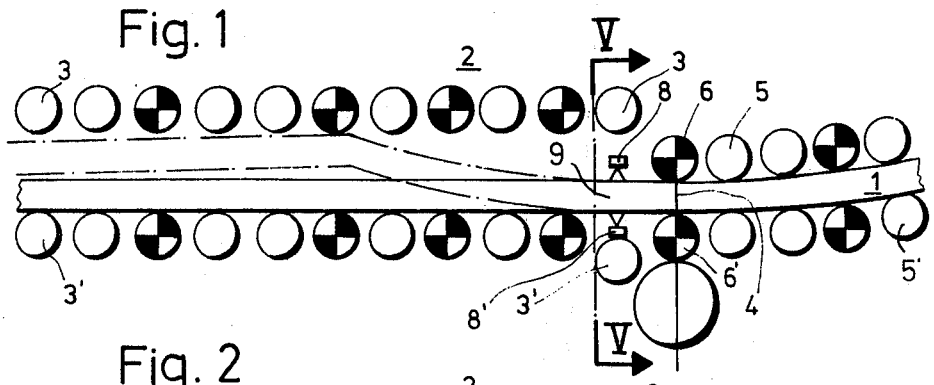
FIGS. 1–4 schematically show an arrangement according to the invention and illustrate the method of the invention.

Describing now the drawings, FIG. 1 schematically illustrates part of a continuous casting installation which is here assumed to be suitable for casting blooms or slabs, generally referred to hereinafter as the cast strand 1. This casting installation or plant has a withdrawal and straightening unit which is generally identified by reference numeral 2 and which is located downstream of a not particularly shown conventional roller apron with respect to the casting direction. The withdrawal and straightening unit 2 illustrated here will be seen to comprise a set of upper and lower rollers 5,5', a pair of upper and lower rollers 6,6' and a set of upper and lower rollers 3,3'. The pair of rollers 6,6' is arranged at the tangent point, that is, at the point where the strand changes from a curved configuration to a substantially linear configuration during a normal casting operation, and constitutes the tangent rollers of that strand of the installation here shown.

The upper rollers 3, 5 and 6 of the withdrawal and straightening unit 2 are mounted for movement in the vertical direction in a manner to be described later. The lower roller 3' immediately adjacent the lower tangent roller 6' is similarly mounted for movement in the vertical direction. During the course of a normal casting operation, the upper rollers 3, 5 and 6 will generally be in their lowered positions, whereas the movable lower roller 3' will generally be in its raised position, that is, the upper rollers 3, 5 and 6 and the movable lower roller 3' will generally contact the strand being cast. This strand is here identified by reference numeral 1 and such strand 1 may, for example, be a steel strand.

The casting installation of FIG. 1 may be a single strand or multiple strand installation. Tha components of the installation which have not been illustrated may be of conventional construction and accordingly do not here require further description.

In the event that, for instance, a break-out of the strand 1 occurs in the first section of the roller apron, casting of the strand 1 is discontinued. In a multiple strand installation, this may be achieved by shutting-off the flow of molten metal to the strand 1 and continuing to cast the remaining strand or strands of the installation. In a single strand installation, the flow of molten metal to the strand 1 is likewise shut-off but now the ladle is preferably withdrawn from its position above the strand 1. subsequently, the trailing end of the strand 1 is removed by cutting the strand 1 at a location downstream of the first section of the roller apron and then lifting or laterally withdrawing the trailing end of the strand 1 and the first section of the roller apron from the installation.

The elapsed time form the occurrence of the breakout to the end of the cutting operation varies from situation to situation but is normally between about 1 and 5 hours. During this period of time, the strand 1 cools to such an extent that the bending resistance thereof increases to a point where it can no longer be straightened by the withdrawal and straightening unit 2.

In accordance with the invention, the adjustable upper rollers 3 of the withdrawal and straightening unit 2 are moved to their raised positions as illustrated in FIG. 1. In such FIG. 1 the strand 1, as it appears during the course of a normal casting operation, is shown in full lines. The upward movement of the rollers 3 frees that portion of the upper surface of the strand 1 downstream of the tangent point 4 from confinement. After the upper rollers 3 have been moved to their raised positions, the strand 1 is advanced for a predetermined distance in the casting direction via the driven rollers of the withdrawal and straightening unit 2 which are in engagement therewith. These driven rollers have been indicated in FIGS. 1 and 4 by the therein contained black triangles abutting at their apexes.

Due to the curvature of the strand 1, the distance of travel thereof is limited since the strand 1 eventually abuts against one or more of the upper rollers 3. The position of the strand 1 after abutment thereof against the upper rollers 3 is shown in dash-and-dot lines in FIG. 1.

In the present embodiment, not only are the upper rollers 3 moved to their raised positions but the adjustable lower roller 3' immediately adjacent the lower tangent roller 6' is moved downwardly to its lowered position. The downward displacement of the adjustable lower roller 3' may, for example, be in the order of 20 centimeters.

A heating device 8, which is here assumed to be in the form of a water-cooled, oxygen-gas burner lance, is inserted in the gap between the upper surface of the strand 1 and the upper roller 3 immediately adjacent the upper tangent roller 6. A burner lance 8', similar to the burner lance 8, is inserted in the gap between the adjustable lower roller 3' and the lower surface of the strand 1. Instead of the burner lances 8 and 8', it is possible to use electrical heating devices such as induction heaters. Thus, conceptually heater units 8, 8' may be considered to constitute either burner lances or induction heaters, or, in fact, other suitable heating means for softening the solidified strand to enable bending thereof as will be further explained shortly.

By feeding oxygen and gas to the lances 8 and 8', the strand 1 is heated at its upper and lower surfaces at location 9. Assuming that the strand 1 is heated to a surface temperature of about 800° C and that the surface temperature of the strand 1 at the beginning of the heating operation is approximately 300° C, then the time required to heat the strand may be in the order of about 10–20 minutes.

As heating progresses, the bending strength of the strand 1 at the location 9 decreases. When the temperature of the strand 1 at location 9 has been sufficiently raised, the bending strength of strand 1 at location 9 becomes low enough to enable this strand 1 to be bent at such location 9 via the withdrawal and straightening unit 2. The upper rollers 3 are now lowered to the positions indicated by dash-and-dot lines in FIG. 2, thereby at least partially straightening the strand 1 to the configuration illustrated by dash-and-dot lines in the same Figure. As is evident from FIG. 2, the upper roller 3 located immediately above the burner lance 8 remains in its raised position during straightening of the strand 1.

In order to save further time, the upper rollers 3 may exert pressure against the strand 1 during the heating operation so that the strand 1 is bent as soon as the bending strength thereof at location 9 is sufficiently lowered by the increase in temperature.

The reaction forces which are required for straightening the strand 1 are generated by the upper rollers 5 of the withdrawal and straightening unit 2.

The strand 1 is preferably heated in the vicinity of the tangent point 4 as illustrated. Advantageously, heating of the strand 4 is carried out within about one meter of the tangent point 4. Furthermore, although the strand 1 is shown as being heated at a location 9 downstream of the tangent point 4, it is equally possible to heat the strand 1 at a location upstream of the tangent point 4. It is similarly possible to heat the strand 1 both upstream and downstream of the tangent point 4.

Figure 2:
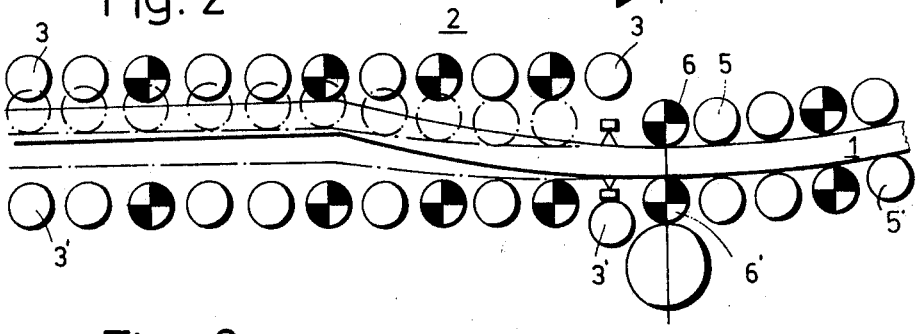

For comparison purposes, FIG. 2 shows, in full lines, the positions of the strand 1 and the upper rollers 3 after the strand 1 has been advanced form the position it had immediately subsequent to the break-out but before the strand 1 has been bent at location 9.

Figure 3:
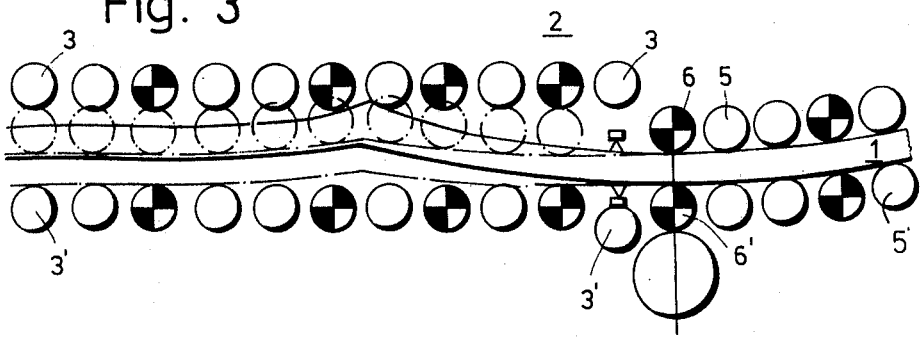

Once the strand 1 has been bent at location 9, the upper rollers 3 are returned to their raised positions as illustrated in FIG. 3. Thereafter, the strand 1 is again advanced as far as possible in the casting direction, as shown by the full line illustration of the strand 1 in FIG. 3, and is again heated in the region of the tangent point 4. When the strand 1 has been sufficiently reheated, the upper rollers 3 are again moved to their lowered positions with a concomitant bending of the strand 1. This situation is illustrated in dash-and-dot lines in FIG. 3.

The preceeding sequence of operations is repeated until the end of the strand 1 enters the withdrawal and straightening unit 2.

Figure 4:
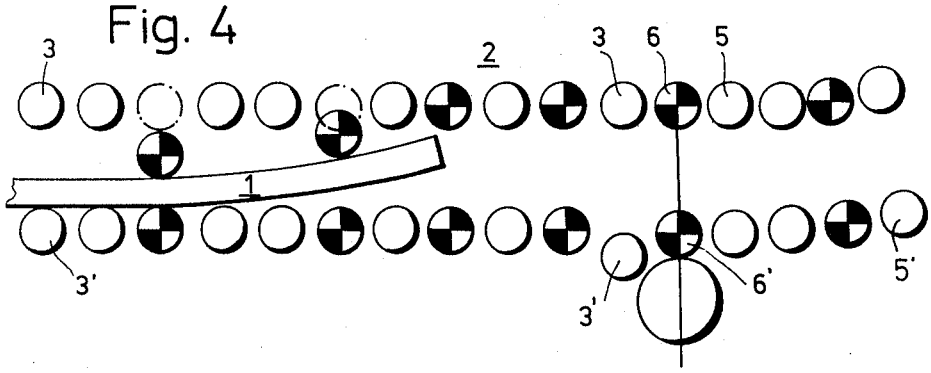

When the end of the strand 1 has entered the withdrawal and straightening unit 2, the upper tangent roller 6 and the upper rollers 5 upstream of the tangent point 4 are moved to their raised positions in order that the strand 1 may be withdrawn from the withdrawal and straightening unit 2. This situation is depicted in FIG. 4. The upper rollers 3 downstream of the tangent point 4 are also in their raised positions with the exception, in the illustrated embodiment, of selected ones thereof which are used to withdraw the strand 1 from the withdrawal and straightening unit 2.

The portion of the strand 1 which remains in the installation subsequent to the break-out may be cut into arbitrary lengths with the burners which are conventionally arranged downstream of the withdrawal and straightening unit 2 for the purpose of cutting the strand 1 into sections during a normal casting operation. The withdrawal and straightening unit 2 may be prepared for normal operation by withdrawing the lances 8 and 8' from their positions between the upper and lower rollers 3 and 3' and by moving the upper rollers 3, 5 and 6 to their lowered positions and the movable lower roller 3' to its raised position.

Figure 5:
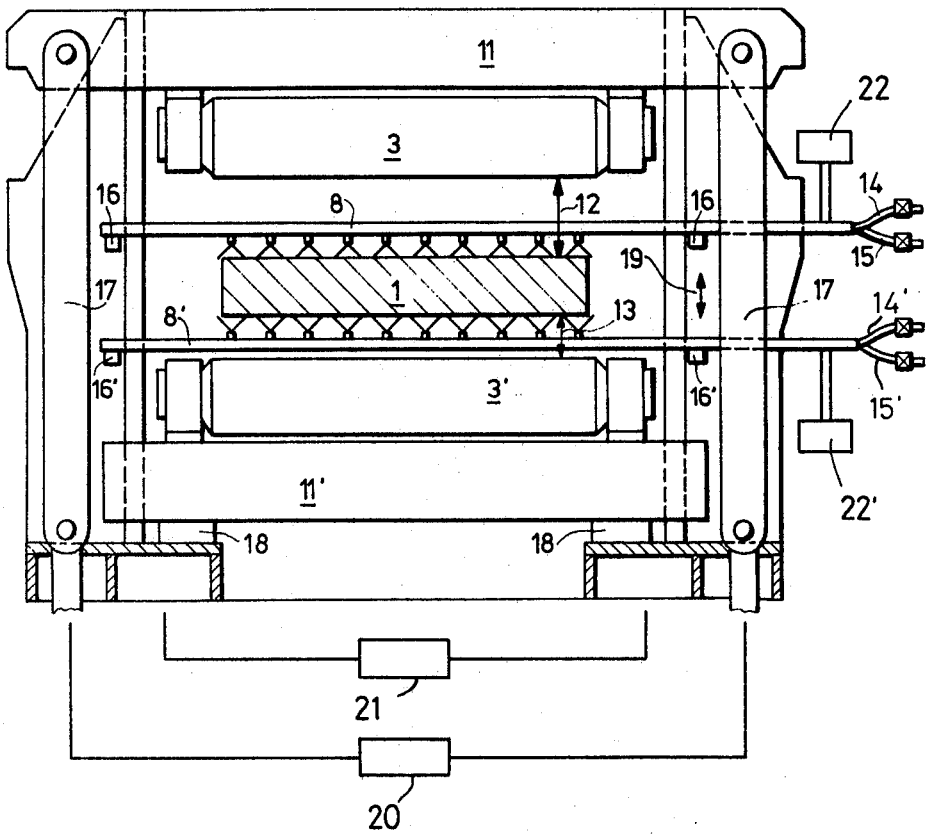
FIG. 5 is a view in the direction of the arrows V—V of FIG. 1.

FIG. 5 illustrates, with reference to a pair of upper and lower rollers 3, 3' one possible manner in which the upper rollers 3, 5 and 6 and lower rollers 3' of the withdrawal and straightening unit 2 may be mounted for displacement in the vertical direction.

The upper roller 3 is mounted at a support 11 which extends transversely of the casting direction. A pair of spaced tension bars 17 is connected to the support 11 and the tension bars 17 are, in turn, connected to non-illustrated hydraulic cylinders which are operated by a suitable drive mechanism 20. The drive mechanism 20 enables the upper roller 3 to be raised to a height 12 above the slab 1. This height 12 may, for instance, be in the order of 40 centimeters. mechanism 20

The lower roller 3' is mounted on a support 11' which, similar to the support 11, extends transversely of the casting direction. The support 11' is mounted on a pair of hydraulic cylinders 18 which, in addition to enabling the support 11' and the roller 3' to be raised and lowered, serve to prevent overloading of the support 11' and the roller 3'. The hydraulic cylinders 18 are driven by a suitable drive mchanism 21. The drive mechanism 21 enables the lower roller 3' to be lowered to a distance 13 below the strand 1. The distance 13 may, for instance, be in the order of 20 centimeters.

The rollers 3, 3', 5 and 6 of the withdrawal and straightening unit 2 may be mounted in such a manner that each can be raised and lowered independently of the others. However, it is also possible for at least some of these rollers to be mounted for movement in unison.

FIG. 5 also illustrates a manner of mounting the burner lances 8 and 8'. The lance 8, which is shown in its operative position between the strand 1 and the upper roller 3, is mounted on a movable support member 16, whereas the lance 8', which is shown in its operative position between the strand 1 and the lower roller 3', is mounted on a movable support member 16'. As schematically indicated by the doubleheaded arrow 19 and as will be further explained later, the support members 16 and 16' may be moved in the vertical direction. This has the advantage that the levels of the lances 8 and 8' may be adjusted to compensate for varying strand thicknesses and thereby obtain optimum heat transfer for all strand thicknesses.

In order to provide for most effective heat transfer from the lances 8 and 8' to the strand 1 and, concomitantly, to protect the neighboring rollers of the withdrawal and straightening unit 2, especially the tangent rollers 6 and 6', from excessive heat, it is possible to insert asbestos plates or other protective plates between the lances 8 and 8' and the respective neighboring rollers of the withdrawal and straightening unit 2.

As also shown in FIG. 5, the burner lance 8 is provided with a conduit 14 for an oxygen-fuel mixture and a conduit 15 for cooling fluid. Similarly, the burner lance 8' is provided with a conduit 14' for an oxygen-fuel mixture and a conduit 15' for cooling fluid. Suitable drive mechanisms or displacement means 22 and 22' may be provided for displacement of the lances 8 and 8', respectively, in the direction of the double-headed arrow 19 and/or transversely of the casting direction. Also, manual movement of the lances or other heater means is equally possible, and thus, the term "displacement means" as used herein is intended to also encompass this possibility.

The invention enables the time for removing a cooled strand from a continuous casting installation to be reduced from that required heretofore. This is of importance with respect to the scheduling of a continuous casting installation, particularly when sequence casting is employed. Furthermore, since the strand need only be heated in accordance with the invention, and not melted as in the prior art, the possibility of damage to the rollers of the withdrawal and straightening unit and their bearings is reduced.

While there are shown and described present preferred embodiments of the invention, it is to be distinctly understood that the invention is not limited thereto, but may be otherwise variously embodied and practiced within the scope of the following claims. ACCORDINGLY,

I claim:

1. A method of removing a cooled off stationary arcuate cast strand moving in a predetermined casting direction from a continuous casting installation, which installation includes a withdrawal and straightening zone having a pressure-exerting upper surface for bending said strand, comprising the steps of:

(a) raising said upper surface so as to permit advancement of said cooled off strand in the casting direction;

(b) advancing said cooled off strand in the casting direction;

(c) heating said cooled off strand to a temperature sufficient to enable said strand to be bent by said upper surface, said heating being carried out at a selected location such as to permit at least partial straightening of said strand via said upper surface; and (d) bending said strand at said location while the latter is at said temperature by lowering said upper surface and thereby exerting pressure on said strand.

2. The method of claim 1 in which said steps are repeated.

3. The method of claim 1 in which said strand is advanced into engagement with said upper surface.

4. The method of claim 1 in which pressure is exerted on said strand by said upper surface during said heating.

5. The method of claim 1 in which said upper surface is downstream of a tangent point of the strand in the casting direction and said location is in the region of the tangent point.

6. The method of claim 1 in which heat is applied to said strand at the upper and lower surfaces thereof.

7. The method of claim 1 in which said strand is heated to a surface temperature between about 600° and 900° C.

8. The method of claim 1 in which said strand is heated by combustion of an oxygen-fuel mixture.

9. The method of claim 1 in which said strand is heated by induction.

10. A continuous casting installation for casting at least one arcuate strand comprising:

(a) a withdrawal and straightening unit for the withdrawal and straightening of the arcuate strand, said unit having an upper portion which is movable from a lowered position in which it normally contacts the strand to a raised position in which it is normally out of contact with the strand; and (b) a heating device movable from a first position laterally of said unit to a second position between said upper portion and the strand when said upper portion is in said raised position, said heating device permitting heating of the strand in said second position to thereby lower the bending resistance of the strand after it has cooled off and when the latter resists bending by said unit.

11. The installation of claim 10 in which said upper portion is downstream of a tangent point of the strand in the casting direction and said second position is in the region of said tangent point.

12. The installation of claim 10 in which said heating device comprises at least one burner lance, and supply means is provided for feeding oxygen and fuel to said lance.

13. The installation of claim 10 in which said heating device comprises at least one induction heater.

14. The installation of claim 10 in which a vertically displaceable support unit is provided for said heating device to permit adjustment of the strand-to-heating device distance.

15. The installation of claim 10 in which said upper portion comprises a plurality of rollers.

16. The installation of claim 10, further including means for moving said upper portion between said lowered position and raised position.

17. The installation of claim 10, further including displacement means for selectively moving said heating device between said first position and said second position.

18. The method of claim 1 further including the step of shutting off the flow of molten metal to the strand being cast prior to raising the upper surface of said withdrawal and straightening zone.

* * * * *